US006650295B2

(12) United States Patent
Ollikainen et al.

(10) Patent No.: US 6,650,295 B2
(45) Date of Patent: Nov. 18, 2003

(54) TUNABLE ANTENNA FOR WIRELESS COMMUNICATION TERMINALS

(75) Inventors: Jani Ollikainen, Helsinki (FI); Outi Kivekäs, Espoo (FI); Pertti Vainikainen, Helsinki (FI)

(73) Assignee: Nokia Corporation, Espoo (FI)

( * ) Notice: Subject to any disclaimer, the term of this patent is extended or adjusted under 35 U.S.C. 154(b) by 40 days.

(21) Appl. No.: 10/058,823

(22) Filed: Jan. 28, 2002

(65) Prior Publication Data

US 2003/0142022 A1 Jul. 31, 2003

(51) Int. Cl.[7] ..... H01Q 1/38; H01Q 1/24

(52) U.S. Cl. ..... 343/700 MS; 343/702; 343/850

(58) Field of Search ..... 343/700 MS, 745, 343/846, 829, 830, 702, 850; H01Q 1/24, 1/38

(56) References Cited

U.S. PATENT DOCUMENTS

| | | | | |
|---|---|---|---|---|
| 5,309,163 A | * | 5/1994 | Ngan et al. | 343/700 MS |
| 5,394,159 A | * | 2/1995 | Schneider et al. | 343/700 MS |
| 5,414,434 A | * | 5/1995 | Conant et al. | 343/700 MS |
| 6,140,966 A | | 10/2000 | Pankinaho | 343/700 |
| 6,501,427 B1 | * | 12/2002 | Lilly et al. | 343/700 MS |

FOREIGN PATENT DOCUMENTS

| | | | |
|---|---|---|---|
| EP | 0997974 | 5/2000 | H01Q/9/04 |

OTHER PUBLICATIONS

"Dual frequency planar inverted–F antenna", Liu et al., IEEE Transaction on Antennas and Propagation, vo.45, No. 10, Oct. 1997, pp. 1451–1458.

"A novel dual band patch antenna for GSM band", Fayyaz et al., Proceedings IEEE–APS Conference on Antennas and Propagation for Wireless Communications, Waltham, MA, 1998, pp. 156–159.

"Triple–band planar inverted–F antenna", Song et al., IEEE Antennas andd Propagation International Symposium Digest, vol. 2, Orlando, Florida, Jul. 11–16, 1999, pp. 908–911.

* cited by examiner

*Primary Examiner*—Hoanganh Le
(74) *Attorney, Agent, or Firm*—Ware, Fressola, Van Der Sluys & Adolphson LLP

(57) ABSTRACT

A radio antenna comprising a tuning component, such as a transmission line, coupled to the radiating element for providing a frequency shift from the resonant frequency, and an adjustment mechanism for adjusting the frequency shift by effectively changing the length of the transmission line. The adjustment mechanism comprises one or more extension lines, and a switching mechanism, which can be closed to couple one or more of the extension lines to the transmission line. The tuning component can also be one or more lumped reactive elements.

63 Claims, 8 Drawing Sheets

TUNABLE ANTENNA FOR WIRELESS COMMUNICATION TERMINALS

FIELD OF THE INVENTION

The present invention relates generally to a radio antenna and, more specifically, to an internal multi-band antenna for use in a hand-held telecommunication device, such as a personal mobile communication terminal (PMCT).

BACKGROUND OF THE INVENTION

The development of small antennas for PMCTs has recently received much attention due to size reduction of the handsets, requirements to keep the amount of radio-frequency (RF) power absorbed by a user below a certain level regardless of the handset size, and introduction of multi-mode phones. It would be advantageous, desirable and even necessary to provide internal multi-band antennas to be disposed inside a handset body, and these antennas should be capable of operating in multiple systems such as E-GSM-900 (880 MHz–960 MHz), GSM1800 (1710 MHz–1880 MHz), and PCS1900 (1850 MHz–1990 MHz). Shorted patch antennas, or planar inverted-F antennas (PIFAs), have been used to provide two or more resonance frequencies. For example, Liu et al. (Dual-frequency planar inverted-F antenna, IEEE Transaction on Antennas and Propagation, Vol.45, No.10, October 1997, pp. 1451–1458) discloses a dual-band PIFA; Pankinaho (U.S. Pat. No. 6,140,966) discloses a double-resonance antenna structure for several frequency ranges, which can be used as an internal antenna for a mobile phone; Isohatala et al. (EP 0997 974 A1) discloses a planar antenna having a relatively low specific absorption rate (SAR) value; Liu et al. (Dual-Frequency Planar Inverted-F Antenna, IEEE Transactions on Antennas and Propagation, Vol.45, No. 10, October 1997, pp. 1451–1458) discloses a dual-band antenna element having two connected shorted patches and a single feed; Fayyaz et al. (A novel Dual Band Patch Antenna for GSM, Proceedings IEEE-APS Conference on Antennas and Propagation for Wirless Communications, Waltham, Mass., 1998, pp.156–159) discloses a shorted patch antenna, wherein a length of transmission line is added to one edge of the patch to create two resonant frequencies; and Song et al. (Triple-band planar inverted-F antenna, IEEE Antennas and Propagation International Symposium Digest, Vol.2, Orlando, Fla., Jul. 11–16, 1999, pp.908–911) discloses a triple-band PIFA.

In particular, the antenna, as disclosed in Fayyaz et al., has a quarter wavelength rectangular patch antenna that is shorted on one end and has a resonant frequency f1. A transmission line is added to one edge of the patch that is not parallel to the shorted end of the patch to create two resonant frequencies on either side of f1, while simultaneously removing the resonant frequency f1. In that respect, the antenna of Fayyaz et al. is not tunable.

Today's standard PMCTs operate at two frequency bands (e.g. E-GMS900/1800 in Europe). It would be desirable to have more universal PMCTs, which can be used in multiple systems around the world. For example, the American cellular systems operate at the 850 MHz frequency range (824–894 MHz). It is advantageous and desirable to provide a multi-band internal radio antenna for use in a PMCT that is tunable to cover the system bands of both the European and American cellular systems.

SUMMARY OF THE INVENTION

It is a primary object of the present invention to provide a tunable antenna, such as a tunable patch antenna, operating at one or more radio frequency bands. It is a further object of the present invention to provide a tunable antenna, wherein the bandwidth of one or more of the frequency bands can be increased without deteriorating the performance of the antenna at other frequency bands. The objects can be achieved by providing one or more reactive tuning components to a resonant type antenna, such as a patch antenna, for tuning the resonant frequency or frequencies of the antenna. Preferably, the tuning components include one or more low-loss transmission line sections of suitable length and termination. Alternatively, the tuning components include one or more lumped reactive elements.

According to the first aspect of the present invention, a radio antenna for use in a hand-held telecommunications device has a radiating element having a resonant frequency, a grounding point, and a feed point. The antenna comprises:

- a transmission line having a length between a first end and an opposing second end, the second end coupled to the radiating element for providing a frequency shift from the resonant frequency, and
- an adjustment means, disposed adjacent to the first end of the transmission line, for adjusting the frequency shift by effectively changing the length of the transmission line.

According to the present invention, the adjustment means may comprise:

- an extension line, and
- a switching mechanism, operable in a first position and a second position, wherein
- when the switching mechanism is operated in the first position, the extension line is electrically coupled to the first end of the transmission line for changing the frequency shift, and
- when the switching mechanism is operated in the second position, the transmission line and the extension line are electrically uncoupled.

According to the present invention, the adjustment means may comprise:

- a plurality of extension lines, each having a different extension length, and
- a switching mechanism, operable in a first position and a second position, wherein
- when the switching mechanism is operated in the first position, one of the extension lines is electrically coupled to the first end of the transmission line for changing the frequency shift by a shift amount commensurable with the extension length of the coupled extension line, and
- when the switching mechanism is operated in the second position, the transmission line and the extension lines are electrically uncoupled.

According to the present invention, the antenna may have a further radiating element having a further resonant frequency. The antenna may comprise

- a further transmission line having a length between a first end and an opposing second end, the second end coupled to the radiating element for providing a further frequency shift from the further resonant frequency, and
- an adjustment means is further adapted to adjusting the further frequency shift by effectively changing the length of the further transmission line.

According to the present invention, the adjustment means may also comprise:

one or more further extension lines, and a further switching mechanism, operable in a first position and a second position, wherein when the further switching mechanism is operated in the first position, one of the further extension lines is electrically coupled to the first end of the further transmission line for changing the further frequency shift, and when the switching mechanism is operated in the second position, the further transmission line and the further extension lines are electrically uncoupled.

According to the second aspect of the present invention, a hand-held telecommunications device has a radio antenna having a resonant frequency for communicating with other communication devices, and a chassis with a chassis ground for disposing the radio antenna, wherein the antenna comprises:

a radiating element, a feed point, a grounding point connected to the chassis ground, a transmission line having a length between a first end and an opposing second end, the second end coupled to the radiating element for providing a frequency shift from the resonance frequency, and an adjustment means, disposed adjacent to the first end of the transmission line, for adjusting the frequency shift by effectively changing the length of the transmission line. The adjustment means may comprise:

one or more extension lines, each having a different extension length, and a switching mechanism, operable in a first position and a second position, wherein when the switching mechanism is operated in the first position, one of the extension lines is electrically coupled to the first end of the transmission line for changing the frequency shift by a shift amount commensurable with the extension length of the coupled extension line, and when the switching mechanism is operated in the second position, the transmission line and the extension lines are electrically uncoupled.

According to the present invention, the antenna may have a further a radiating element having a further resonant frequency. The antenna may comprise a further transmission line having a length between a first end and an opposing second end, the second end coupled to the radiating element for providing a further frequency shift from the further resonance frequency, and an adjustment means is further adapted to adjusting the further frequency shift by effectively changing the length of the further transmission line.

According to the third aspect of the present invention, there is provided a method of tuning a radio antenna for use in a hand-held telecommunications device having a chassis ground, wherein the antenna includes a radiating element having a resonant frequency, a grounding point coupled to the chassis ground, and a feed point. The method comprises the steps of:

providing a transmission line having a length coupled to the radiating element for providing a frequency shift from the resonant frequency, and providing an adjustment means for adjusting the frequency shift by effectively changing the length of the transmission line.

According to the present invention, the adjustment means comprises:

one or more extension lines, each having a different extension length, and a switching mechanism operable in a first position and a second position, wherein when the switching mechanism is operated in the first position, one of the extension lines is electrically coupled to the transmission line for changing the frequency shift by a shift amount commensurable with the extension length of the coupled extension line, and when the switching mechanism is operated in the second position, the transmission line and the extension lines are electrically uncoupled.

According to the present invention, the radio antenna also comprises a further a radiating element having a further resonant frequency, and the method further comprises the steps of:

providing a further transmission line coupled to the radiating element for providing a further frequency shift from the further resonance frequency, and providing a further adjusting mechanism for adjusting the further frequency shift by effectively changing the length of the further transmission line. The further adjustment means comprises:

one or more further extension lines each having a different extension length, and a further switching mechanism operable in a first position and a second position, wherein when the further switching mechanism is operated in the first position, one of the further extension lines is electrically coupled to the further transmission line for changing the further frequency shift by a shifting amount commensurable with the extension length of the coupled further extension line, and when the switching mechanism is operated in the second position, the further transmission line and the further extension lines are electrically uncoupled.

According to the fourth aspect of the present invention, there is provided a radio antenna for use in a hand-held telecommunications device, said antenna including a radiating element having a resonant frequency, a grounding point and a feed point. The antenna comprises:

a tuning component having a first end and an opposing second end, the second end coupled to the radiating element for providing a frequency shift from the resonant frequency, and an adjustment means, disposed adjacent to the first end of the tuning component, for adjusting the frequency shift.

According to the present invention, the tuning component comprises a lumped reactive element.

The present invention will become apparent upon reading the description taken in conjunction with FIGS. 1 to 7*b*.

BEST MODE TO CARRY OUT THE INVENTION

Figure 1:
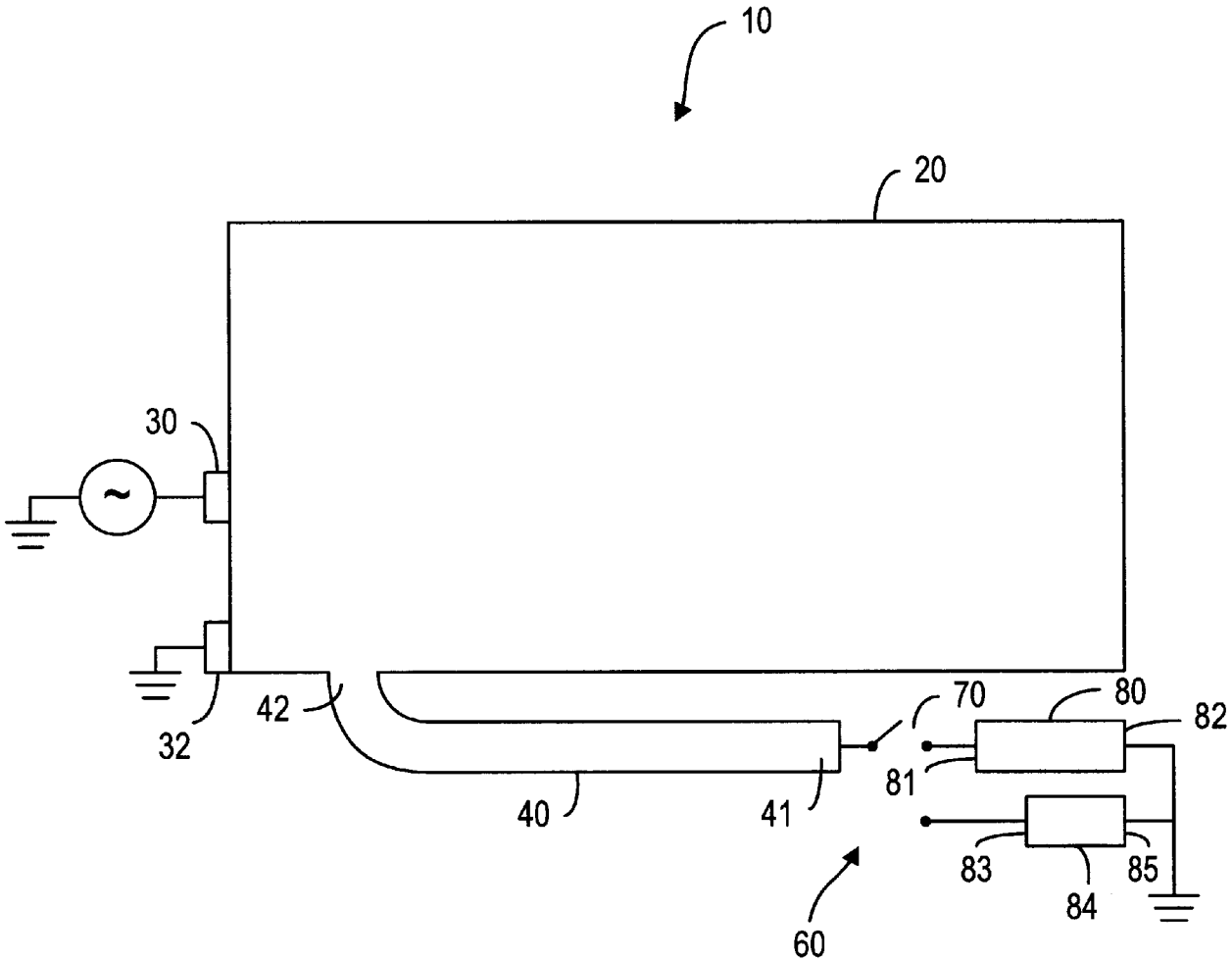
FIG. 1 is a diagrammatic representation showing the antenna, according to the preferred embodiment of the present invention.
Figure 3:
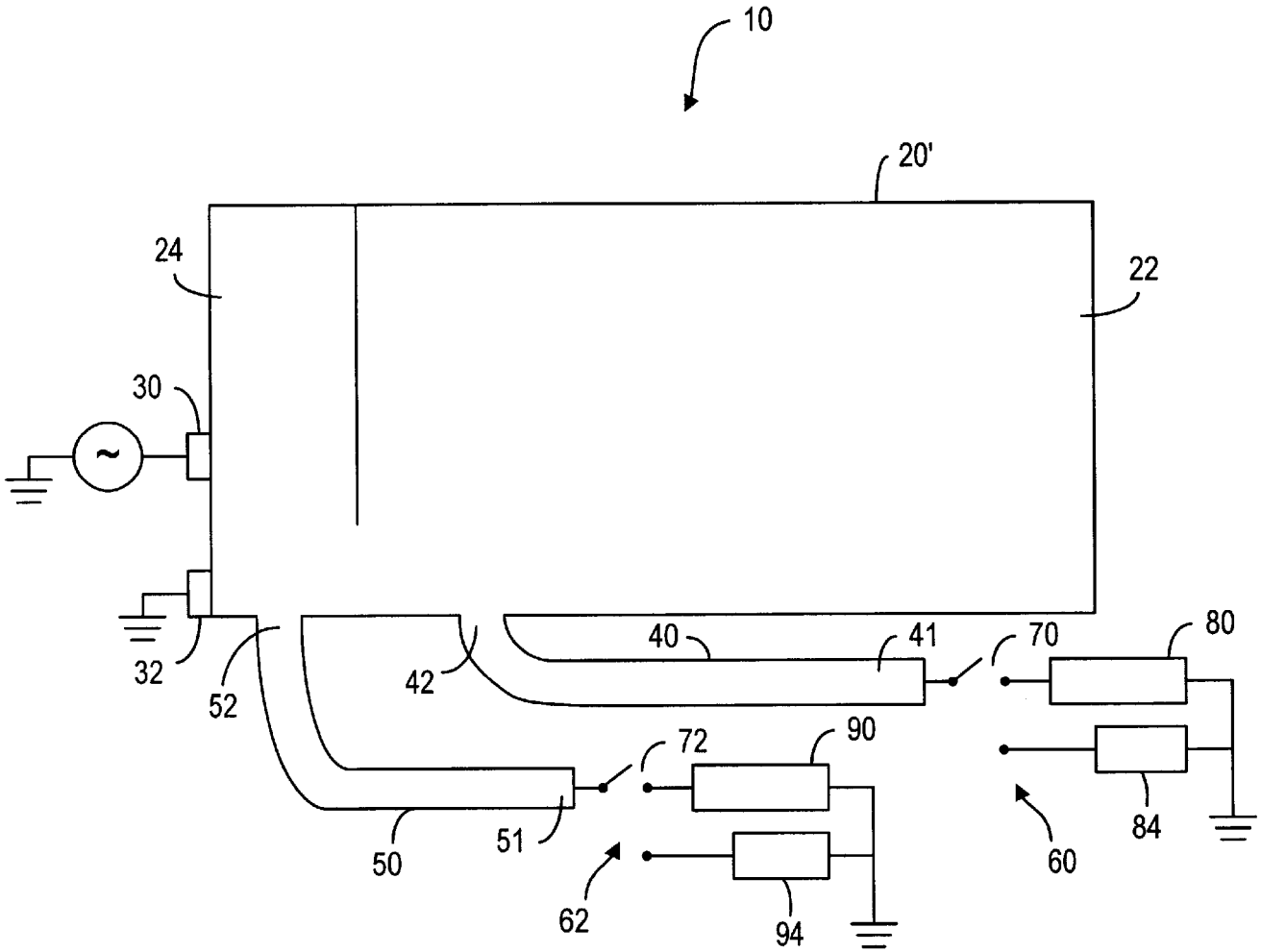
FIG. 3 is a diagrammatic representation showing another embodiment of the present invention.
Figure 4:
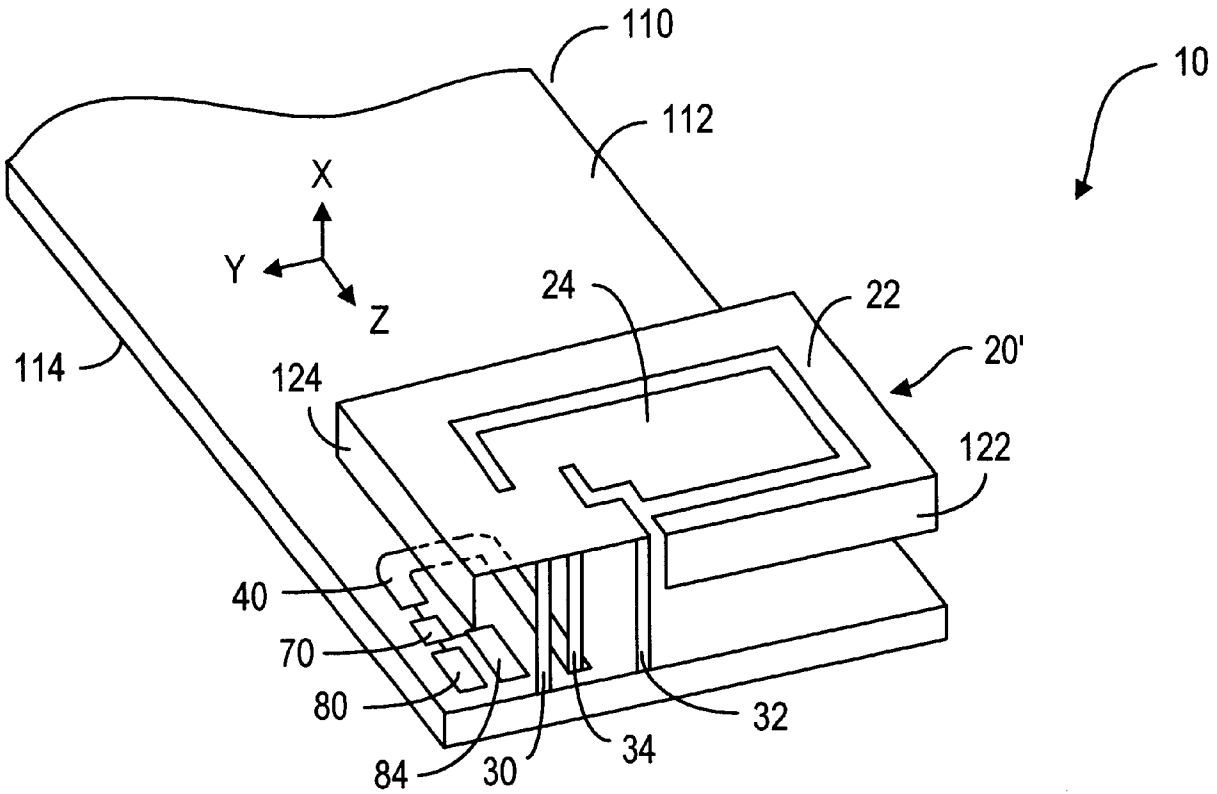
FIG. 4 is an isometric view showing an exemplary implementation of the present invention.

FIG. 1 shows a schematic representation of an antenna 10, according to the preferred embodiment of the present invention. As shown, the antenna 10 has a radiating element 20, which is shorted by a grounding pin 32, and a feed line 30. Preferably, the antenna is a low-profile printed antenna, such as a microstrip patch antenna or a planar inverted-F antenna (PIFA), so that the tuning circuit, according to the present invention, can be easily integrated to the antenna. However, the tuning circuit and the method of tuning, according to present invention, can be applied to any other resonant antenna type, such as a simple monopole whip, a dielectric resonator antenna (DRA), or a normal-mode helix. As shown, a tuning element, such as a lumped reactive element or a section of a transmission line 40, has a first end 41 and a second end 42 coupled to the radiating element 20. The coupling between the radiating element 40 and the second end 42 of the transmission line 40 can be an ohmic contact or a capacitive coupling, for example. Elements that increase the capacitance between the transmission line 40 and the radiating element 20 can also be used. The transmission line 40 may also be an integral part of the radiating element 20. It should be noted that the transmission line 40 shown in FIGS. 1 to 3 can be coupled to the radiating element 20 in a location, and be shaped in a way, as shown in FIG. 4. However, the coupling location and the shape of the transmission line 40 can be varied for appropriately controlling the electrical coupling between the transmission line 40 and the radiating element 20, and thus the frequency shift.

As shown in FIG. 1, an adjustment circuit 60 is used for tuning the resonant frequency of the antenna 10 by effectively changing the length of the transmission line 40. The adjustment circuit 60 comprises one or more extension lines 80, 84, and a switching component 70 for linking one of the extension lines 80, 84 to the first end 41 of the transmission line 40. The switching component 70 is operable in a first position and a second position, wherein when the switching component 70 is operated in the first position, it provides an electrical coupling between the first end 41 of the transmission line 40 and one of the extension lines 80, 84. When the switching component 70 is operated in the second position, it remains open so as to leave the transmission line 40 and the extension lines 80, 84 uncoupled.

The switching component 70 can be a PIN-diode, or other switching mechanism. Because the switching component 70 is not directly connected to the radiating element 20, but is separated from it by the transmission line 40, the power loss in the switching component 70 and the transmission line 40 can be reduced. A practical figure of merit for the tuning circuit, including the transmission line 40 and adjustment circuit 60, is the ratio of the tuning range over losses (TRL). A larger value of TRL means lower losses for a given frequency shift and the tuning circuit is considered better. By plotting TRL as a function of $L_T$ (the length of the transmission line 40 in FIG. 1, for example) and $L_E$ (the length of the extension lines 80, 84 in FIG. 1, for example) in both switching states (closed and open), several combinations of $L_T$ and $L_E$ can be found which minimize the loss for a certain frequency shift. However, in space-limited applications, it is advantageous to select the one with the shortest $L_T$ and $L_E$. This will also minimize the losses caused by the transmission lines and the extension lines.

For example, when the switch is connected in series, one end of the extension line is short circuited (as in FIG. 1) and the length of the extension line $L_E$ is short ($<0.1\lambda$), the efficiency of the antenna (and TRL) in the closed position of the switch is maximized when the effective length of the transmission line 40 $L_{T,eff}=0.25\lambda$ (including the effects of the reactive components resulted from the coupling arrangement, switching component, and any other possible reactive components attached to the line 40). However, in this case the efficiency (and TRL) in the open position of the switch is minimized. If $L_{T,eff}$ is increased or decreased from $0.25\lambda$, the efficiency decreases in the closed position of the switch, but increases rapidly in the open position of the switch. By adjusting $L_{T,eff}$, an optimal balance of the efficiencies in the open and closed positions of the switch can be found. The optimal balance depends, of course, on the application. One optimum can be, for example, equal efficiencies in both states. If $L_{T,eff}$ is decreased from $0.25\lambda$, the direction of tuning is such that the resonant frequency increases when the switch is closed. If equal efficiencies in both positions of the switch are required, good results are typically obtained when the effective length of transmission line 40 ($L_{T,eff}$) is slightly smaller than its resonant length ($L_{T,eff}=0.25\lambda$), for example $L_{T,eff}=0.20\lambda \ldots 0.24\lambda$.

If $L_{T,eff}$ is increased from $0.25\lambda$, the direction of tuning is such that the resonant frequency decreases when the switch is closed. If equal efficiencies in both positions of the switch are required, good results are typically obtained when the effective length of transmission line 40 ($L_{T,eff}$) is slightly greater than its resonant length ($L_{T,eff}=0.25\lambda$), for example $L_{T,eff}=0.26\lambda \ldots 0.29\lambda$. After a suitable balance of efficiencies between the open and closed positions has been found by adjusting the lengths of $L_T$ and $L_E$, the desired frequency shift can be set by adjusting the coupling between the radiating element and the tuning circuit.

Figure 2:
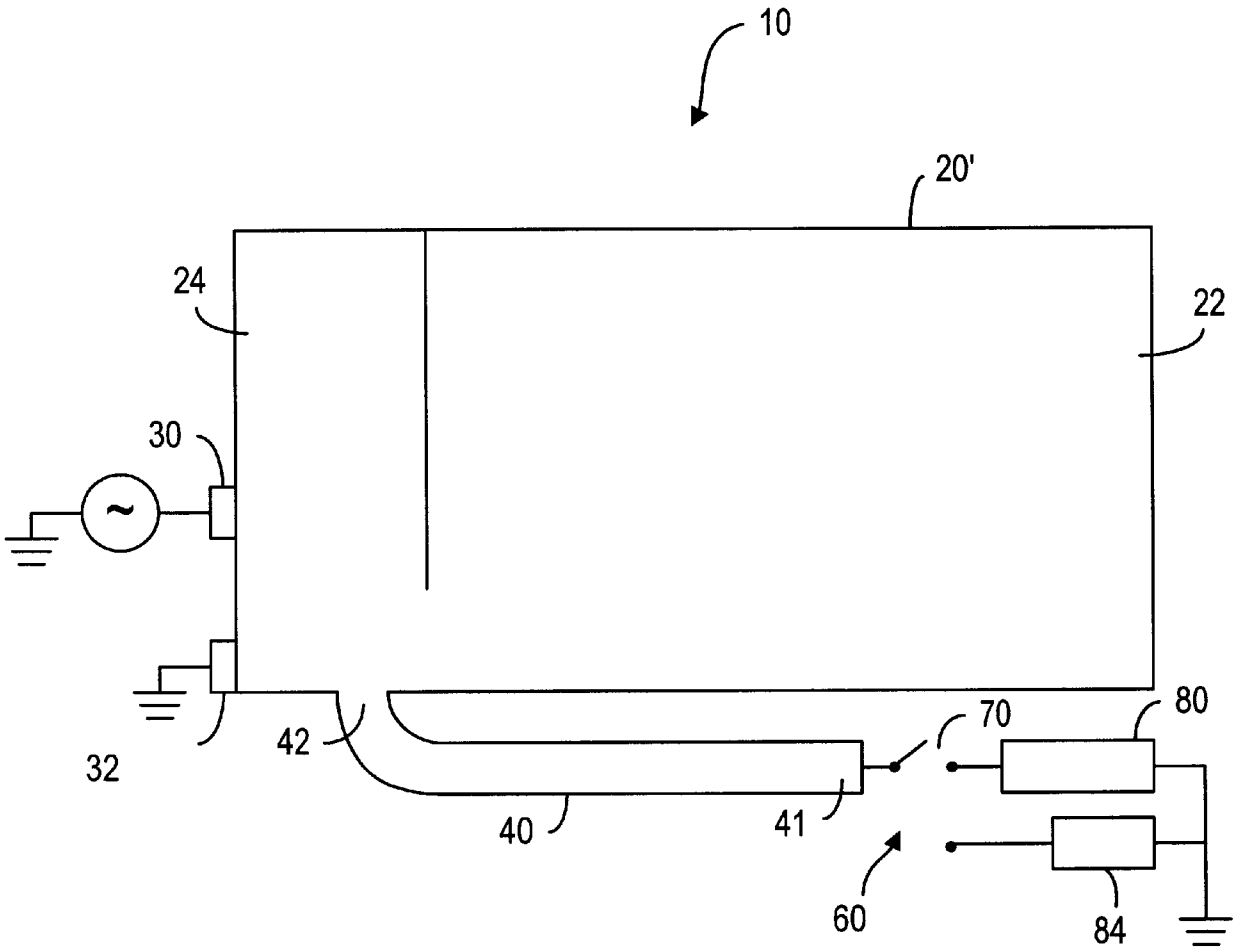
FIG. 2 is a diagrammatic representation showing the antenna of FIG. 1, wherein the antenna has two radiating elements.

FIG. 2 is a schematic representation of an antenna 10 having a radiating part 20', which comprises two radiating elements 22, 24 each having a resonant frequency. However, only one resonant frequency is subjected to tuning. For example, if the resonant frequency of the radiating element 22 is lower than the resonant frequency of the radiating element 24 and the tuning is used to adjust the lower frequency, then the length of the transmission line 40 and the extension lines 80, 84 is selected in accordance with the wavelength $\lambda$ corresponding to the lower resonant frequency. It has been found that coupling the transmission line 40 and the adjustment circuit 60 to the antenna does not considerably deteriorate the performance of the higher frequency component. It should be noted that, when a tuning circuit is coupled to the radiating element of a multi-band antenna, the bandwidth of the antenna can increase. However, both the lower and the upper frequency bands can be effectively widened by way of tuning.

It is also possible to separately tune the upper frequency band and the lower frequency band. As shown in FIG. 3, a further transmission line 50 and a further adjustment circuit 62 are provided for tuning the upper frequency band associated with the resonant frequency of the radiating element 24. As shown, the transmission line 50 has a first end 51 and a second end 52, which is electrically coupled to the radiating part 20'. Similar to the adjustment circuit 60, the adjustment circuit 62 comprises a switching component 72 and one or more extension lines 90 and 94. Similar to the switching component 70, the switching component 72 is operable in a first position for electrically coupling one of the extension lines 90 to the first end 51 of the transmission line 50.

FIG. 4 is an isometric view showing an exemplary configuration of the antenna 10, according to the present invention. As shown, the antenna 10 is disposed on a chassis 110. The chassis 110 has an upper side 112 facing the antenna 10, and a lower side 114 having a ground plane to allow the radiating elements 22 and 24 to be shorted via the ground pin 32. The tuning circuit is disposed on the upper side 112 of the chassis 110, separated from the ground plane by a dielectric layer. As shown in FIG. 4, the pin 34, which is used to connect the radiating part 20', is located near the grounding pin 32. The sections 122 and 124 on the radiating part 20' are capacitive loads.

Figure 5:
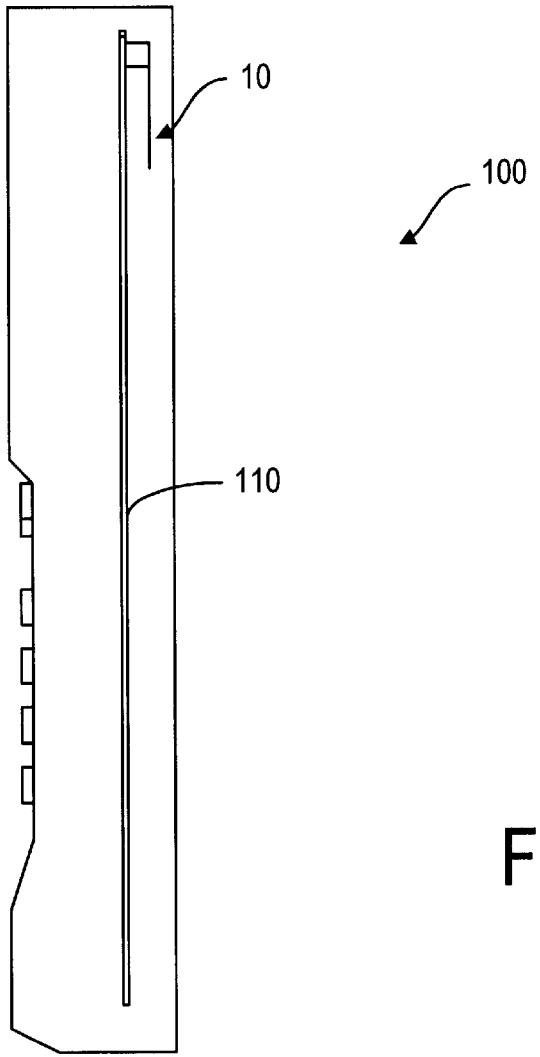
FIG. 5 is a diagrammatic representation of a hand-held telecommunication device having an antenna, according to the present invention.

FIG. 5 is a schematic representation of a hand-held telecommunications device 100 having a chassis 110 to implement the antenna 10, according to the present invention. The hand-held device 100 can be a personal mobile communication terminal (PMCT), a communicator device, a personal data assistant (PDA) or the like.

It should be noted that the switching components 70 and 72 can be PIN-diodes, but they can be other switching mechanisms, such as FET switches and MEM (microelectromechanical) switches. Furthermore, while two extension lines 80, 84 are used for tuning the radiating part 20, 20', as shown in FIGS. 1–3, it is possible to use one extension line or three or more extension lines for tuning. Moreover, the transmission line 40, as depicted in FIG. 4, is connected to the radiating part 20' via a pin 34. It is possible that the coupling between the transmission line 40 and the radiating part 20' is capacitive. Elements that increase the capacitance between the transmission line 40 and the radiating part 20' can be used in the capacitive coupling. One or both transmission lines 40, 50, as shown in FIGS. 1–3, can be totally or partly replaced by lumped reactive elements. Thus, the element 40 in FIGS. 1–3 can be a lumped reactive element or the combination of a transmission line and a lumped reactive element. Likewise, one or more of the extension lines 80, 84, 90, 94 can also be replaced by lumped reactive elements.

Figure 6:
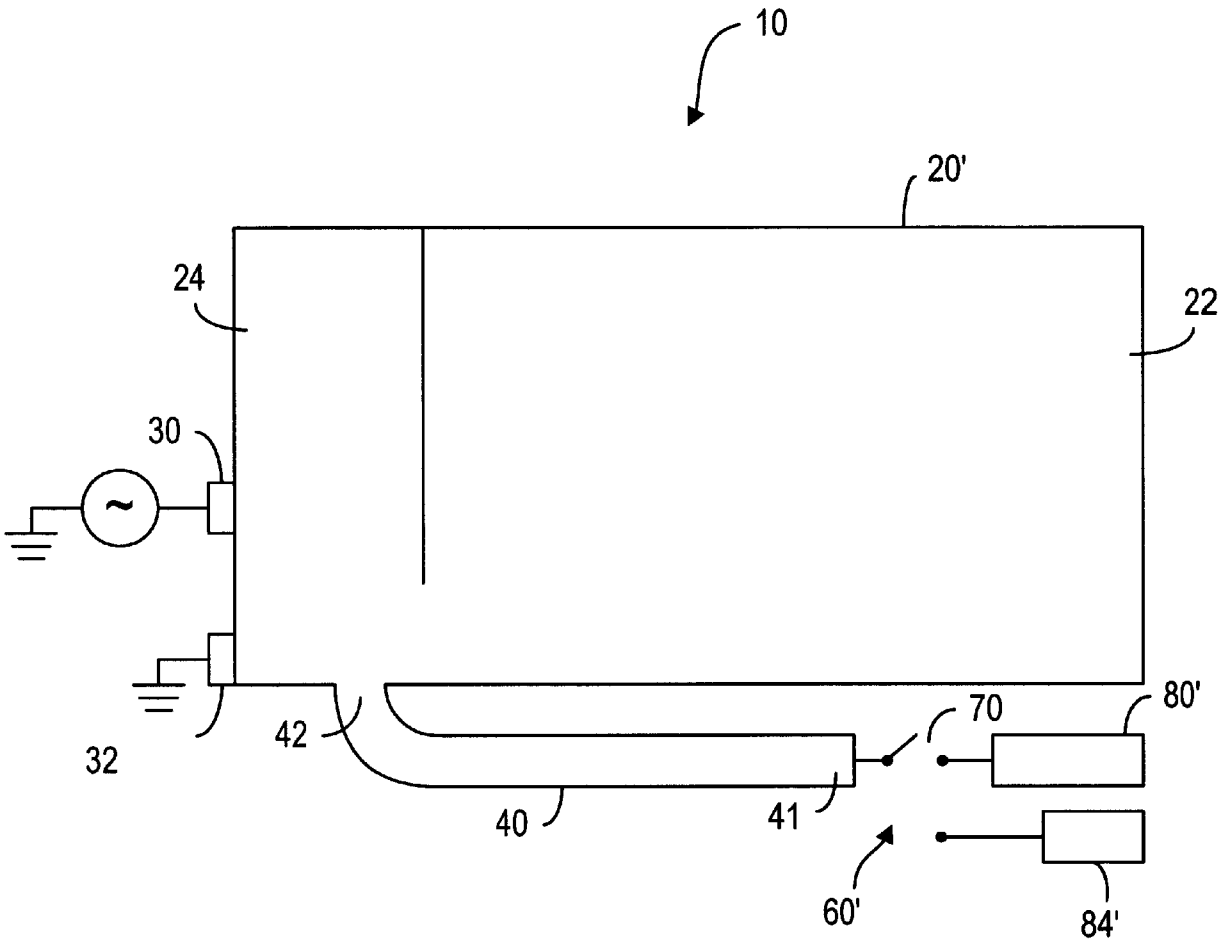
FIG. 6 is diagrammatic representation showing the antenna of FIG. 2, wherein the extension lines are not ground.
Figure 7A:
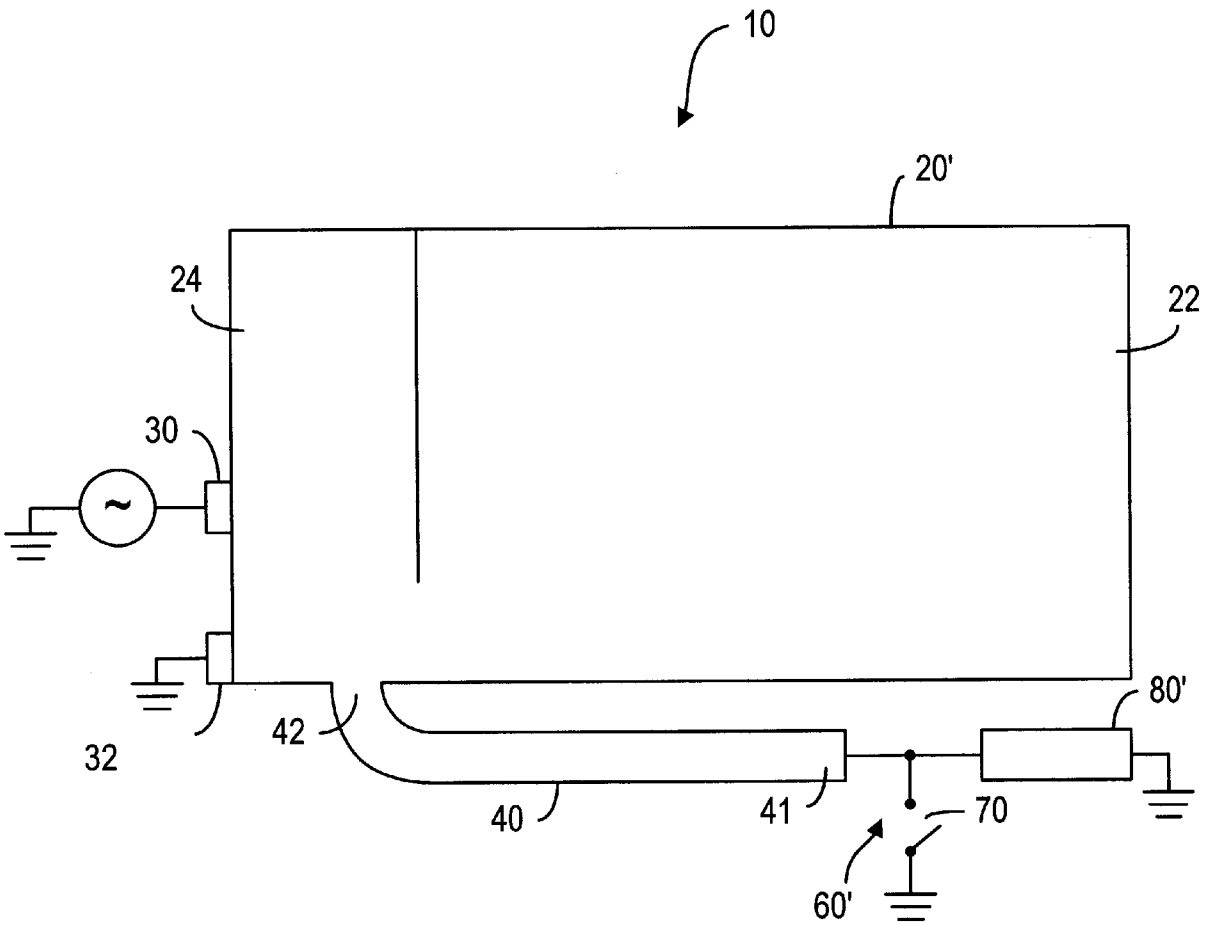
FIG. 7*a* is a diagrammatic representation showing an antenna having a transmission line coupled to an extension line and a switch in parallel.
Figure 7B:
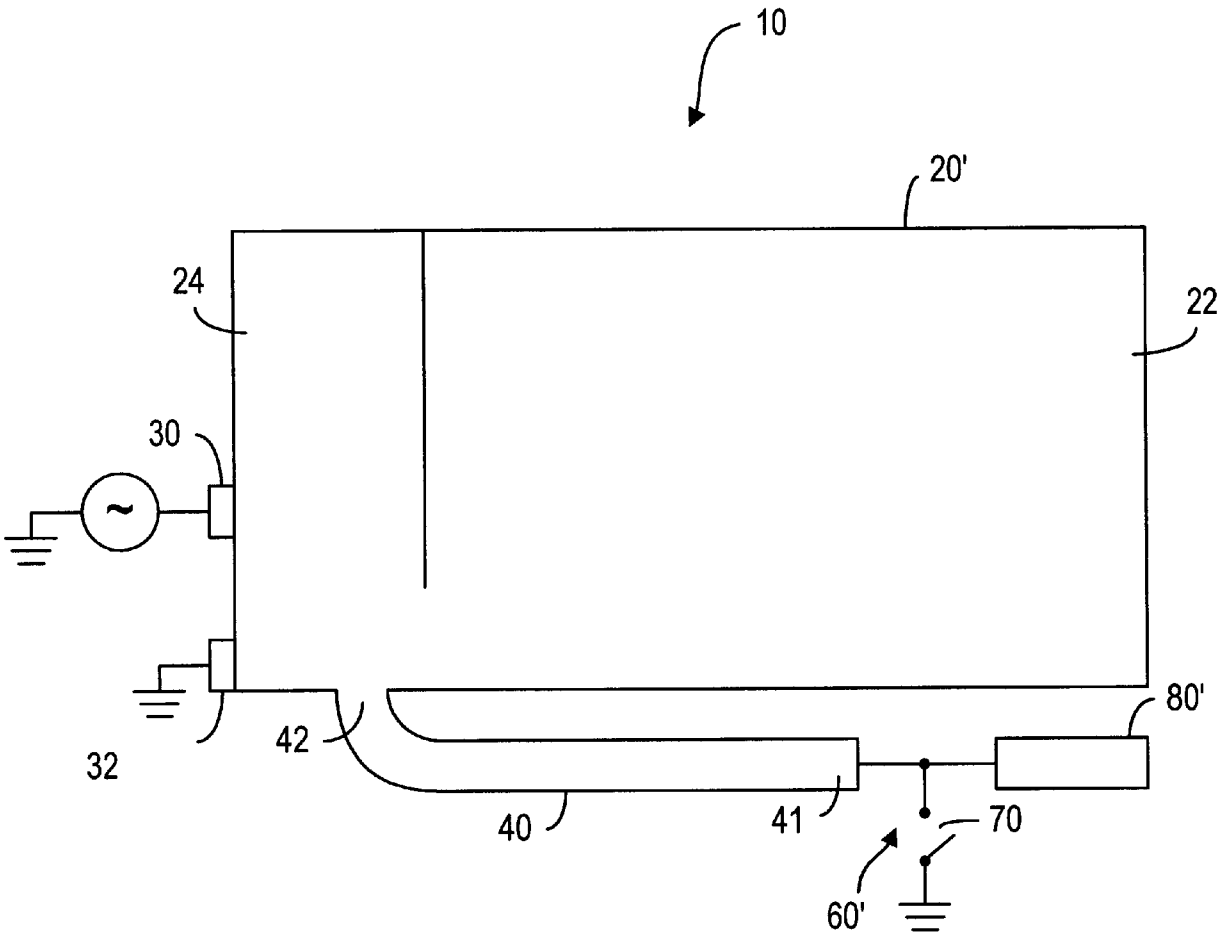
FIG. 7*b* is a diagrammatic representation showing the antenna of FIG. 7*a*, wherein the extension line is open-circuited.

Moreover, the extension lines 80, 84, 90 and 94 are not necessarily shorted at one end thereof, as shown in FIGS. 1–3. Some or all of the extension lines can be open-circuited, as shown in FIG. 6. Furthermore, the switches 70 and 72 are not necessarily connected in series with the extension lines, as shown in FIGS. 1–3. The switches can be connected in parallel with the extension lines, as shown in FIG. 7*a*. Even when the extension lines are not short-circuited, as shown in FIG. 7*b*, a shunt switch can also be used. The performance of the antenna configurations, as shown in FIGS. 6–7*b*, can also be optimized using plots of TRL as a function of $L_T$ (the length of the transmission line 40 in FIGS. 6–7*b*, for example) and $L_E$ (the length of the extension lines 80' in FIGS. 6–7*b*, for example) in both switching states (closed and open). Several combinations of $L_T$ and $L_E$ can be found which minimize the loss for a certain frequency shift.

Thus, although the invention has been described with respect to a preferred embodiment thereof, it will be understood by those skilled in the art that the foregoing and various other changes, omissions and deviations in the form and detail thereof may be made without departing from the scope of this invention.

What is claimed is:

1. A radio antenna for use in a hand-held telecommunications device, said antenna including a radiating element having a resonant frequency, a grounding point and a feed point, said antenna comprising:

a transmission line having a length between a first end and an opposing second end, the second end coupled to the radiating element for providing a frequency shift from the resonant frequency, and an adjustment means, disposed adjacent to the first end of the transmission line, for adjusting the frequency shift by effectively changing the length of the transmission line.

2. The radio antenna of claim 1, wherein the adjustment means comprises:

an extension line, and a switching mechanism, operable in a first position and a second position, wherein when the switching mechanism is operated in the first position, the extension line is electrically coupled to the first end of the transmission line for changing the frequency shift, and when the switching mechanism is operated in the second position, the transmission line and the extension line are electrically uncoupled.

3. The radio antenna of claim 2, wherein the telecommunications device has a device ground for shorting the antenna through the grounding point, and the extension line has a first line end and a second line end coupled to the device ground, wherein when the switching mechanism is operated in the first position, the first line end of the extension line is electrically coupled to the first end of the transmission line.

4. The radio antenna of claim 2, wherein the switching mechanism comprises a PIN-diode.

5. The radio antenna of claim 2, wherein the switching mechanism comprises a MEM switch.

6. The radio antenna of claim 2, wherein the switching mechanism comprises an FET switch.

7. The radio antenna of claim 1, further comprising:

a further radiating element having a further resonant frequency, and a further transmission line having a length between a first end and an opposing second end, the second end coupled to the radiating element for providing a further frequency shift from the further resonance frequency, wherein the adjustment means is further adapted to adjusting the further frequency shift by effectively changing the length of the further transmission line.

8. The radio antenna of claim 7, wherein the adjustment means further comprises:

a further extension line, and a further switching mechanism, operable in a first position and a second position, wherein when the further switching mechanism is operated in the first position, the further extension line is electrically coupled to the first end of the further transmission line for changing the further frequency shift, and when the switching mechanism is operated in the second position, the further transmission line and the further extension lines are electrically uncoupled.

9. The radio antenna of claim 8, wherein the further switching mechanism comprises a PIN-diode.

10. The radio antenna of claim 8, wherein the further switching mechanism comprises a MEM switch.

11. The radio antenna of claim 8, wherein the further switching mechanism comprises an FET switch.

12. The radio antenna of claim 8, wherein the telecommunications device has a device ground for shorting the antenna through the grounding point, and the extension line has a first line end and a second line end coupled to the device ground, wherein when the switching mechanism is operated in the first position, the first line end of the extension line is electrically coupled to the first end of the transmission line.

13. The radio antenna of claim 7, wherein the further transmission line comprises a lumped reactive element.

14. The radio antenna of claim 1, wherein the transmission line comprises a lumped reactive element.

15. The radio antenna of claim 1, wherein the telecommunications device has a device ground and the adjustment means comprises:

an extension line having one end coupled to the first end of the transmission line; and a switching mechanism operable in a first position and a second position, wherein when the switching mechanism is operated in the first position, the coupled end of the extension line is coupled to the device ground, and when the switching mechanism is operated in the second position, the extension line and the device ground are electrically uncoupled.

16. The radio antenna of claim 1, wherein the telecommunications device has a device ground and the adjustment means comprises:

an extension line having a first end and a second end, wherein the first end of the extension line is coupled to the first end of the transmission line, and the second end of the extension line is coupled to the device ground; and a switching mechanism operable in a first position and a second position, wherein when the switching mechanism is operated in the first position, the first end of the extension line is also coupled to the device ground, and when the switching mechanism is operated in the second position, the first end of the extension line and the device ground are electrically uncoupled.

17. A radio antenna for use in a hand-held telecommunications device, said antenna including a radiating element having a resonant frequency, a grounding point and a feed point, said antenna comprising:

a transmission line having a length between a first end and an opposing second end, the second end coupled to the radiating element for providing a frequency shift from the resonant frequency, and an adjustment means, disposed adjacent to the first end of the transmission line, for adjusting the frequency shift by effectively changing the length of the transmission line, wherein the adjustment means comprises:

a plurality of extension lines each having a different extension length, and a switching mechanism, operable in a first position and a second position, wherein when the switching mechanism is operated in the first position, one of the extension lines is electrically coupled to the first end of the transmission line for changing the frequency shift by a shift amount commensurable with the extension length of the coupled extension line, and when the switching mechanism is operated in the second position, the transmission line and said plurality of extension lines are electrically uncoupled.

18. The radio antenna of claim 17, wherein the telecommunications device has a device ground for shorting the antenna through the grounding point, and each of said plurality of extension lines has a first line end and a second line end coupled to the device ground, and wherein when the switching mechanism is operated in the first position, the first line end of said one extension line is electrically coupled to the first end of the transmission line.

19. A radio antenna for use in a hand-held telecommunications device, said antenna including a radiating element having a resonant frequency, a grounding point and a feed point, said antenna comprising:

a transmission line having a length between a first end and an opposing second end, the second end coupled to the radiating element for providing a frequency shift from the resonant frequency, an adjustment means, disposed adjacent to the first end of the transmission line, for adjusting the frequency shift by effectively changing the length of the transmission line, a further radiating element having a further resonant frequency, and a further transmission line having a length between a first end and an opposing second end, the second end coupled to the radiating element for providing a further frequency shift from the further resonance frequency, wherein the adjustment means is further adapted to adjusting the further frequency shift by effectively changing the length of the further transmission line, wherein the adjustment means further comprises:

a plurality of further extension lines, each having a different extension length, and a further switching mechanism, operable in a first position and a second position, wherein when the further switching mechanism is operated in the first position, one of the further extension lines is electrically coupled to the first end of the further transmission line for changing the further frequency shift by a shift amount commensurable with the extension length of the coupled further extension line, and when the switching mechanism is operated in the second position, the further transmission line and said plurality of further extension lines are electrically uncoupled.

20. The radio antenna of claim 19, wherein the telecommunications device has a device ground for shorting the antenna through the grounding point, and each of said plurality of extension lines has a first line end and a second line end coupled to the device ground, and wherein when the switching mechanism is operated in the first position, the first line end of said one extension line is electrically coupled to the first end of the transmission line.

21. A radio antenna for use in a hand-held telecommunications device, said antenna including a radiating element having a resonant frequency, a grounding point and a feed point, said antenna comprising:

a transmission line having a length between a first end and an opposing second end, the second end coupled to the radiating element for providing a frequency shift from the resonant frequency, and an adjustment means, disposed adjacent to the first end of the transmission line, for adjusting the frequency shift by effectively changing the length of the transmission line, wherein the second end of the transmission line is coupled to the radiating element by capacitive coupling.

22. A radio antenna for use in a hand-held telecommunications device, said antenna including a radiating element having a resonant frequency, a grounding point and a feed point, said antenna comprising:

a transmission line having a length between a first end and an opposing second end, the second end coupled to the radiating element for providing a frequency shift from the resonant frequency, and an adjustment means, disposed adjacent to the first end of the transmission line, for adjusting the frequency shift by effectively changing the length of the transmission line, wherein the second end of the transmission line is coupled to the radiating element via an electrically conducting pin.

23. A hand-held telecommunications device comprising:

a radio antenna having a resonant frequency for communicating with other communication devices, and a chassis having a chassis ground for disposing the radio antenna, wherein the antenna comprises:

a radiating element, a feed point, a grounding point connected to the chassis ground, a transmission line having a length between a first end and an opposing second end, the second end coupled to the radiating element for providing a frequency shift from the resonant frequency, and an adjustment means, disposed adjacent to the first end of the transmission line, for adjusting the frequency shift by effectively changing the length of the transmission line.

24. The telecommunications device of claim 23, wherein the adjustment means comprises:

an extension line, and a switching mechanism operable in a first position and a second position, wherein when the switching mechanism is operated in the first position, the extension line is electrically coupled to the first end of the transmission line for changing the frequency shift, and when the switching mechanism is operated in the second position, the transmission line and the extension line are electrically uncoupled.

25. The telecommunications device of claim 24, wherein the extension line has a first line end and a second line end coupled to the chassis ground, and wherein when the switching mechanism is operated in the first position, the first line end of the extension line is electrically coupled to the first end of the transmission line.

26. The telecommunications device of claim 24, wherein the switching mechanism comprises a PIN-diode.

27. The telecommunications device of claim 24, wherein the switching mechanism comprises a MEM switch.

28. The telecommunications device of claim 24, wherein the switching mechanism comprises an FET switch.

29. The telecommunications device of claim 23, further comprising:

a further radiating element having a further resonant frequency, and a further transmission line having a length between a first end and an opposing second end, the second end coupled to the radiating element for providing a further frequency shift from the further resonant frequency, wherein the adjustment means is further adapted to adjusting the further frequency shift by effectively changing the length of the further transmission line.

30. The telecommunications device of claim 29, wherein the adjustment means further comprises:

a further extension line, and a further switching mechanism operable in a first position and a second position, wherein when the further switching mechanism is operated in the first position, the further extension line is electrically coupled to the first end of the further transmission line for changing the further frequency shift, and when the switching mechanism is operated in the second position, the further transmission line and the further extension lines are electrically uncoupled.

31. The telecommunications device of claim 30, wherein the extension line has a first line end and a second line end coupled to the chassis ground, and wherein when the switching mechanism is operated in the first position, the first line end of the extension line is electrically coupled to the first end of the transmission line.

32. The telecommunications device of claim 29, wherein the further transmission line comprises a lumped reactive element.

33. The telecommunications device of claim 29, wherein the further switching mechanism comprises a PIN-diode.

34. The telecommunications device of claim 29, wherein the further switching mechanism comprises a MEM switch.

35. The telecommunications device of claim 29, wherein the further switching mechanism comprises an FET switch.

36. The telecommunications device of claim 23, wherein the transmission line comprises a lumped reactive element.

37. A hand-held telecommunications device comprising:

a radio antenna having a resonant frequency for communicating with other communication devices, and a chassis having a chassis ground for disposing the radio antenna, wherein the antenna comprises:

a radiating element, a feed point, a grounding point connected to the chassis ground, a transmission line having a length between a first end and an opposing second end, the second end coupled to the radiating element for providing a frequency shift from the resonant frequency, and an adjustment means, disposed adjacent to the first end of the transmission line, for adjusting the frequency shift by effectively changing the length of the transmission line, wherein the adjustment means comprises:

a plurality of extension lines each having a different extension length, and a switching mechanism operable in a first position and a second position, wherein when the switching mechanism is operated in the first position, one of the extension lines is electrically coupled to the first end of the transmission line for changing the frequency shift by a shift amount commensurable with the extension length of the coupled extension line, and when the switching mechanism is operated in the second position, the transmission line and said plurality of extension lines are electrically uncoupled.

38. The telecommunications device of claim 37, wherein each of said plurality of extension lines has a first line end and a second line end coupled to the chassis ground, and wherein when the switching mechanism is operated in the first position, the first line end of said one extension line is electrically coupled to the first end of the transmission line.

39. A hand-held telecommunications device comprising:

a radio antenna having a resonant frequency for communicating with other communication devices, and a chassis having a chassis ground for disposing the radio antenna, wherein the antenna comprises:

a radiating element, a feed point, a grounding point connected to the chassis ground, a transmission line having a length between a first end and an opposing second end, the second end coupled to the radiating element for providing a frequency shift from the resonant frequency, an adjustment means, disposed adjacent to the first end of the transmission line, for adjusting the frequency shift by effectively changing the length of the transmission line, a further radiating element having a further resonant frequency, and a further transmission line having a length between a first end and an opposing second end, the second end coupled to the radiating element for providing a further frequency shift from the further resonant frequency, wherein the adjustment means is further adapted to adjusting the further frequency shift by effectively changing the length of the further transmission line, wherein the adjustment means further comprises:

a plurality of further extension lines, each having a different extension length, and a further switching mechanism operable in a first position and a second position, wherein when the further switching mechanism is operated in the first position, one of the further extension lines is electrically coupled to the first end of the further transmission line for changing the further frequency shift by a shifting amount commensurable with the extension length of the coupled further extension line, and when the switching mechanism is operated in the second position, the further transmission line and said plurality of further extension lines are electrically uncoupled.

40. The telecommunications device of claim 39, wherein each of said plurality of extension lines has a first line end and a second line end coupled to the chassis ground, and wherein when the switching mechanism is operated in the first position, the first line end of said one extension line is electrically coupled to the first end of the transmission line.

41. A method of tuning a radio antenna for use in a hand-held telecommunications device having a chassis ground, wherein the antenna has a radiating element having a resonant frequency, a grounding point coupled to the chassis ground, and a feed point, said method comprising the steps of:

providing a transmission line having a length coupled to the radiating element for providing a frequency shift from the resonant frequency, and providing an adjustment means for adjusting the frequency shift by effectively changing the length of the transmission line.

42. The method of claim 41, wherein the adjustment means comprises:

an extension line, and a switching mechanism operable in a first position and a second position, wherein when the switching mechanism is operated in the first position, the extension line is electrically coupled to transmission line for changing the frequency shift, and when the switching mechanism is operated in the second position, the transmission line and the extension line are electrically uncoupled.

43. The method of claim 42, wherein the extension line has a first end and a second line end coupled to the chassis ground, and wherein when the switching mechanism is operated in the first position, the first line end of the extension line is electrically coupled to the transmission line.

44. The method of claim 41, wherein the radio antenna further comprising:

a further a radiating element having a further resonant frequency, said method further comprising the steps of:

providing a further transmission line coupled to the radiating element for providing a further frequency shift from the further resonance frequency, and providing a further adjusting mechanism for adjusting the further frequency shift by effectively changing the length of the further transmission line.

45. The method of claim 44, wherein the further adjustment means comprises:

a further extension line, and a further switching mechanism operable in a first position and a second position, wherein when the further switching mechanism is operated in the first position, the further extension line is electrically coupled to the further transmission line for changing the further frequency shift, and when the switching mechanism is operated in the second position, the further transmission line and the further extension lines are electrically uncoupled.

46. The method of claim 44, wherein the further adjustment means comprises:

a plurality of further extension lines each having a different extension length, and a further switching mechanism operable in a first position and a second position, wherein when the further switching mechanism is operated in the first position, one of the further extension lines is electrically coupled to the further transmission line for changing the further frequency shift by a shifting amount commensurable with the extension length of the coupled further extension line, and when the switching mechanism is operated in the second position, the further transmission line and said plurality of further extension lines are electrically uncoupled.

47. The method of claim 44 wherein the further transmission line comprises a lumped reactive element.

48. The method of claim 41, wherein the transmission line comprises a lumped reactive element.

49. A method of tuning a radio antenna for use in a hand-held telecommunications device having a chassis ground, wherein the antenna has a radiating element having a resonant frequency, a grounding point coupled to the chassis ground, and a feed point, said method comprising the steps of:

providing a transmission line having a length coupled to the radiating element for providing a frequency shift from the resonant frequency, and providing an adjustment means for adjusting the frequency shift by effectively changing the length of the transmission line, wherein the adjustment means comprises:

a plurality of extension lines, each having a different extension length, and a switching mechanism operable in a first position and a second position, wherein when the switching mechanism is operated in the first position, one of the extension lines is electrically coupled to the transmission line for changing the frequency shift by a shift amount commensurable with the extension length of the coupled extension line, and when the switching mechanism is operated in the second position, the transmission line and said plurality of extension lines are electrically uncoupled.

50. The method of claim 49, wherein each of said plurality of extension lines has a first line end and a second line end coupled to the chassis ground, and wherein when the switching mechanism is operated in the first position, the first line end of said one extension line is electrically coupled to the transmission line.

51. A radio antenna for use in a hand-held telecommunications device, said antenna including a radiating element having a resonant frequency, a grounding point and a feed point, said antenna comprising:

a tuning component having a first end and an opposing second end, the second end coupled to the radiating element for providing a frequency shift from the resonant frequency, and an adjustment means, disposed adjacent to the first end of the tuning component, for adjusting the frequency shift.

52. The radio antenna of claim 51, wherein the adjustment means comprises:

a tuning element, and a switching mechanism operable in a first position and a second position, wherein when the switching mechanism is operated in the first position, the tuning element is electrically coupled to the first end of the tuning component for changing the frequency shift, and when the switching mechanism is operated in the second position, the tuning element and the tuning component are electrically uncoupled.

53. The radio antenna of claim 52, wherein the tuning component comprises a lumped reactive element and the tuning element comprises an extension line.

54. The radio antenna of claim 53, wherein the telecommunications device has a device ground for shorting the antenna through the grounding point, and the extension line has a first line end and a second line end coupled to the device ground, wherein when the switching mechanism is operated in the first position, the first line end of the extension line is electrically coupled to the first end of the lumped reactive.

55. The radio antenna of claim 52, further comprising:

a further radiating element having a further resonant frequency, and a further tuning component having a first end and an opposing second end, the second end coupled to the radiating element for providing a further frequency shift from the further resonance frequency, wherein the adjustment means is further adapted to adjusting the further frequency shift.

56. The radio antenna of claim 55, wherein the tuning component comprises a lumped reactive element and the further tuning component comprises a further lumped reactive element.

57. The radio antenna of claim 56, wherein the tuning element comprises an extension line and the adjustment means further comprises:

a further extension line, and a further switching mechanism operable in a first position and a second position, wherein when the further switching mechanism is operated in the first position, the further extension line is electrically coupled to the first end of the further lumped reactive element for changing the further frequency shift, and when the switching mechanism is operated in the second position, the further lumped reactive element and the further extension lines are electrically uncoupled.

58. The radio antenna of claim 51, wherein the tuning component comprises a lumped reactive element.

59. The radio antenna of claim 51, further comprising:

a further radiating element having a further resonant frequency, and a further tuning component having a first end and an opposing second end, the second end coupled to the radiating element for providing a further frequency shift from the further resonance frequency, wherein the adjustment means is further adapted to adjusting the further frequency shift.

60. The radio antenna of claim 59, wherein the tuning component comprises a lumped reactive element and the further tuning component comprises a further lumped reactive element.

61. A radio antenna for use in a hand-held telecommunications device, said antenna including a radiating element having a resonant frequency, a grounding point and a feed point, said antenna comprising:

a tuning component having a first end and an opposing second end, the second end coupled to the radiating element for providing a frequency shift from the resonant frequency, and an adjustment means, disposed adjacent to the first end of the tuning component, for adjusting the frequency shift, wherein the adjustment means comprises:

a plurality of extension lines each having a different extension length, and a switching mechanism operable in a first position and a second position, wherein when the switching mechanism is operated in the first position, one of the extension lines is electrically coupled to the first end of the tuning component for changing the frequency shift by a shift amount commensurable with the extension length of the coupled extension line, and when the switching mechanism is operated in the second position, the tuning component and said plurality of extension lines are electrically uncoupled.

62. The radio antenna of claim 61, wherein the tuning component comprises a lumped reactive element.

63. A radio antenna for use in a hand-held telecommunications device, said antenna including a radiating element having a resonant frequency, a grounding point and a feed point, said antenna comprising:

a tuning component having a first end and an opposing second end, the second end coupled to the radiating element for providing a frequency shift from the resonant frequency, and an adjustment means, disposed adjacent to the first end of the tuning component, for adjusting the frequency shift, wherein the adjustment means comprises:

a tuning element, and a switching mechanism operable in a first position and a second position, wherein when the switching mechanism is operated in the first position, the tuning element is electrically coupled to the first end of the tuning component for changing the frequency shift, and when the switching mechanism is operated in the second position, the tuning element and the tuning component are electrically uncoupled, and the radio antenna further comprises:

a further radiating element having a further resonant frequency, and a further tuning component having a first end and an opposing second end, the second end coupled to the radiating element for providing a further frequency shift from the further resonance frequency, wherein the adjustment means is further adapted to adjusting the further frequency shift, wherein the tuning component comprises a lumped reactive element and the further tuning component comprises a further lumped reactive element and, wherein the adjustment means further comprises:

a plurality of further extension lines, each having a different extension length, and a further switching mechanism, operable in a first position and a second position, wherein when the further switching mechanism is operated in the first position, one of the further extension lines is electrically coupled to the first end of the further lumped reactive element for changing the further frequency shift by a shift amount commensurable with the extension length of the coupled further extension line, and when the switching mechanism is operated in the second position, the further lumped reactive element and said plurality of further extension lines are electrically uncoupled.

* * * * *